US006464733B2

(12) United States Patent
Ryser

(10) Patent No.: US 6,464,733 B2
(45) Date of Patent: Oct. 15, 2002

(54) TINTING PLASTIC ARTICLES

(76) Inventor: Christophe U. Ryser, 1410 Lakeshore Drive, Dorval, Quebec (CA), H9S 2E6

( * ) Notice: Subject to any disclaimer, the term of this patent is extended or adjusted under 35 U.S.C. 154(b) by 84 days.

(21) Appl. No.: 09/792,301

(22) Filed: Feb. 23, 2001

(65) Prior Publication Data

US 2002/0040511 A1 Apr. 11, 2002

Related U.S. Application Data

(63) Continuation of application No. PCT/CA99/00803, filed on Sep. 2, 1999.

(30) Foreign Application Priority Data

Sep. 3, 1998 (CA) ..... 2246505

(51) Int. Cl.[7] ..... D06P 5/20; D06P 3/36; C08J 3/28

(52) U.S. Cl. ..... 8/444; 8/506

(58) Field of Search ..... 8/444, 506

(56) References Cited

U.S. PATENT DOCUMENTS 5,560,751 A 10/1996 Hoshiyama

FOREIGN PATENT DOCUMENTS

GB 2270576 * 3/1994

OTHER PUBLICATIONS

K. Haggag et al, Dyeing Polyester with Microwave Heating Using Disperse Dyestuffs, 107 American Dyestuff Reporter, 84 (1995) Mar. No. 3, Secaucus, NJ, US pp. 22 to 36.

Japanese Abstract J55132761 10/80.

* cited by examiner

*Primary Examiner*—Margaret Einsmann
(74) *Attorney, Agent, or Firm*—Bachman & LaPointe, P.C.

(57) ABSTRACT

Plastic articles, especially plastic optical lenses are tinted by immersing the plastic article in an aqueous dispersion of tinting agent and exposing the dispersion and immersed article to microwave radiation to bring the dispersion to ebullition; the ebullition is maintained for at least 2 seconds with transfer of tinting agent from the dispersion to the article to tint the article; the tinted article is removed from the dispersion and rinsed with water. The method achieves tinting in significantly shorter times than conventional methods and employs water-based dispersions thereby avoiding emission of vapors of organic solvents.

22 Claims, No Drawings

TINTING PLASTIC ARTICLES

CROSS-REFERENCE TO RELATED APPLICATION

This Application is a Continuation of PCT/CA 99/00803, filed Sep. 2, 1999, in which the United States of America was designated and elected and which remains pending in the International Phase until Mar. 3, 2001.

TECHNICAL FIELD

This invention relates to a method of tinting a plastic article; the invention is especially concerned with tinting plastic optical lenses, especially ophthalmic lenses, for use in spectacles and other eye wear, to provide a colour tint or ultraviolet (UV) light transmission inhibiting tint.

BACKGROUND ART

Tinting of optical lenses for spectacles and sunglasses is widely employed either to apply an aesthetic, fashion oriented coloured tint to eye wear or to apply a tint which functions to block or inhibit transmission of ultraviolet light in eye wear, while additionally providing a desired aesthetic or fashionable appearance.

Current techniques for tinting optical lenses involve immersing the lens in a bath comprising solution or dispersion of a tinting dye or pigment which is heated to a temperature typically of 75 to 85° C. and maintained well below boiling temperature. The heating is achieved by heat exchange, wherein pots containing the tinting dye or pigment are surrounded by a heat transfer fluid which may be a silicone oil or other heat transfer oil. Typically it takes about 60 minutes to heat the bath from room temperature to 75 to 85° C. by this conventional technique. The lenses are inserted into the hot bath, typically by means of a lens holder which maintains the lens in an upright or vertical disposition.

As the temperature of the lens rises in the hot bath, the surface pores of the lens open and dye or pigment penetrates to effect tinting. Opening of the surface pores and initial tinting typically takes 5 minutes, but in order to achieve a dark sunglass tint colour, the lens typically needs to be maintained immersed in the hot bath for 15 minutes or more, and in particular up to 45 minutes for a dark tint.

Different optical plastics are employed in lens manufacture. Some optical plastics are tintable, having surface pores which will receive a tinting dye or pigment, for example, diethylene glycol bis(allyl carbonate) known as CR-39. Other optical plastics such as polycarbonates are not-tintable or are difficult to tint.

In some cases optical lenses are provided with a thin, hard surface coating, typically about 2 microns, these hard surface coatings permit tinting but conventional tinting techniques require long tinting times, for example, several hours. Hard surface coatings may be, for example, of vinyl polyester or polysiloxane.

These hard surface coatings do permit tinting of optical lenses of non-tintable plastic, but as indicated above long tinting times are required. These hard surface coatings are also employed, in some cases, on otherwise tintable lenses such as CR-39 lenses, rendering such lenses more difficult to tint.

These prior techniques employ low energy dye pigments available for optical use, which pigments disintegrate within a few hours if exposed to temperatures of 95° C. or higher.

U.S. Pat. No. 5,560,751 describes another conventional technique in which a thin liquid coating of a tinting solution is formed on a surface of a lens by spinning the lens at 1000 to 2000 rpm while applying the tinting solution dropwise to the lens surface, whereafter the resulting coated lens is heated causing the dye in the coating to be absorbed.

Canadian Patent Specification 2,095,703 describes a method for producing a photochromic plastic lens in which the lens is immersed in a high boiling organic solvent bath containing the dye and exposed to microwave heating, typically for about 6 minutes, whereafter the lens was allowed to soak in the hot bath for about 15 minutes.

The use of organic solvents is costly and use of hot solvents requires special handling facilities and equipment to avoid or minimize escape of vapors of the hot solvents into the atmosphere with the consequent hazards to the environment and to personnel involved in the tinting operation.

It is thus desirable to develop tinting techniques which avoid the use of hot organic solvents, while at the same time shortening the time required for tinting and avoiding the need for special or costly equipment.

SUMMARY OF THE INVENTION

The invention seeks to provide a tinting method in which tinting is achieved in short times.

The invention further seeks to provide a tinting method which avoids the need for costly equipment or handling facilities and employs water-based materials.

In accordance with the invention there is provided a method of tinting a tintable plastic article comprising: i) immersing a tintable plastic article in an aqueous dispersion of a tinting agent; ii) exposing said aqueous dispersion with said immersed article to microwave radiation to bring said dispersion to ebullition; iii) maintaining said ebullition for a time period of at least about 2 seconds with transfer of tinting agent from said dispersion to said article to effect tinting, iv) removing the resulting tinted article from said dispersion; and v) rinsing the tinted article with water to remove residual dispersion.

DETAILED DESCRIPTION OF THE INVENTION i) Plastic Articles

The invention is applicable to tintable plastic articles generally, especially small articles, but has particular application to plastic optical lenses employed in eye wear, more especially, spectacles, sunglasses and protective eye wear, such as eye shields and goggles.

It is to be understood that "tintable plastic articles" in the context of the invention, contemplates articles such as lenses which are either of a plastic which is itself tintable, or have a surface coating which is tintable.

The tinting method may be employed to provide a tint of a desired colour, for aesthetic or fashion reasons, or to provide a protective tint effective to reduce, inhibit or block transmission of ultraviolet light through the lens, or for both of these functions.

Typical plastics for eye wear are well established in the eye wear industry and include poly(methyl methacrylate), cellulose acetates, polyvinyl chloride, polyurethanes, polycarbonate and diethylene glycol bis(allyl carbonate).

Within this class of plastics, diethylene glycol bis(allyl carbonate) referred to in the trade as CR-39 is widely employed as a tintable optical lens, both for use in producing a tinted lens of a desired colour and shade, and also for producing lenses with a protective UV tint.

Polycarbonates are also widely employed as optical lens plastic.

ii) Tinting Method a) Pretreatment

The method of the invention is applied to clean lenses and, if necessary, the lenses are subjected to a preliminary cleansing operation. If lenses are being re-tinted or it is desired to change an existing tint, the existing tint is first removed using a technique similar to that of the invention but with a water-based tint removal solution instead of the aqueous dispersion of dye.

In the tint removal operation the tinted lens is immersed in an aqueous solution of a surfactant effective for removal of the tint under the operating conditions.

The solution of surfactant is first exposed to microwave radiation until the solution boils quietly; the tinted lens is immersed in the hot boiling solution and boiling is maintained to liberate the tinting dye from the lens. The operation is continued until the dye is removed from the lens.

The lens is removed from the solution and washed and the aqueous solution containing liberated tinting agent is reused for removal of tint in other lenses or is discarded.

A clean lens which is to be tinted is suitably surface conditioned by immersing the lens in an aqueous solution of a surfactant which is effective to reduce or lower surface tension on the surfaces of the lens, such that the tinting dispersion uniformly coats the surfaces of the lens when the lens is immersed in the tinting dispersion.

One suitable surfactant for this purpose is that available under the Trade-mark KIRALON-OL from BASF, however, other suitable surfactants can be readily identified by trial and experiment.

The surface conditioning can be carried out at room temperature; suitably the lens is immersed in the aqueous solution of surfactant for 10 to 40, preferably 15 to 30 seconds, removed and rinsed with water.

It is found that if the surface conditioning is not carried, in some cases the tint produced is not homogeneous.

b) Tinting

In order to tint the lens, an aqueous dispersion of a dye or pigment is selected for the desired colour of tint. The aqueous dispersion is housed in a container and the lens is immersed in the dispersion; the lens may be supported by a lens holder which leaves the major faces of the lens fully exposed or may be placed on the floor of the container with a positive side of the lens, i.e., the convex face of the lens uppermost. In this way, both major faces of the lens, i.e., the concave face and the convex face are exposed to the aqueous dispersion; the dispersion and the immersed lens are heated by microwave energy in a microwave oven until the dispersion reaches ebullition, and preferably a quiescent or non-violent boil. After the boiling state is reached, the lens is maintained in the boiling dispersion for a predetermined time to achieve a desired level of tint.

The dye or pigment in the hot dispersion penetrates the surface pores of the lens, and thus dye or pigment is transferred to the lens across the major surfaces of the lens. The surface pores may be in a coating on the surface of the plastic lens or in the surface defined by the plastic from which the lens is manufactured.

Suitably the container housing the dispersion is supported on a turntable in the microwave oven, which defines a rotating platform. Rotation of the turntable supporting the container of dispersion ensures a uniform heating and uniform temperature throughout the dispersion, which in turn results in a uniform transfer of dye to the lens surfaces. Rotation of the turntable is typically at 2 to 10 rpm, more usually 4 to 8 rpm.

It is found preferable to maintain the exposure of the dispersion and lens to the microwave radiation, on a continuous basis, throughout the tinting. Microwave ovens have different heating operations, some of which provide continuous microwave radiation in a heating cycle, and others of which provide microwave radiation in an interrupted or discontinuous manner in which the microwave radiation is interrupted or discontinued periodically in a heating cycle.

It has been found that use of a continuous exposure to microwave radiation provides faster tinting than the use of an interrupted or discontinuous exposure. Furthermore, the use of continuous microwave radiation is found to be especially important in the case of lenses which are more difficult to tint, such as high index or polycarbonate lens. In these cases the use of continuous microwave radiation resulted in faster tinting and darker tints than could be achieved with discontinuous microwave radiation.

The time for the aqueous dispersion to reach boiling at particular microwave oven operating parameters for a particular microwave oven are predetermined by trial. Likewise the time of immersion of a lens in the dispersion, to reach a desired level of tinting is predetermined by trial.

Immersion times for different levels of tinting may be predetermined by trial for specific operating parameters of a specific microwave oven to provide a table of immersion times and tinting levels, to which reference may be made when a lens is to be tinted.

In general a typical 800 watt power microwave oven at high power will bring 120 ml of aqueous dispersion, having the lens immersed therein, to boiling temperature in about 60 seconds. The boiling is maintained for a time depending on the level of tinting desired. In the case of an uncoated CR-39 lens, tinting is complete in 2 to 60 seconds. Typically, a 2 second immersion produces a tinted lens with 10% absorption of visible light, a 30 second immersion produces 50% absorption and a 60 second immersion produces 72% absorption. Other levels of absorption are achieved by shortening or lengthening the immersion time, a longer time producing a darker tint.

On completion of the tinting, the microwave heating is discontinued, the lens is removed from the hot dispersion and rinsed with water to remove residual dispersion.

The lens is preferably removed immediately from the dispersion at termination of the heating, and continued soaking in the dispersion is avoided. If the lens is left soaking in the dispersion, the tinting by the hot dispersion will continue, even if at a slower rate so that the desired level of tinting may be exceeded.

The dispersion may be used repeatedly to tint further lenses until it is depleted in dye.

Since the dispersion reaches the boiling stage rapidly, it is not necessary to maintain it at boiling in between tinting operations. Thus by allowing the dispersion to cool in between tinting operations, exposure of the dispersion to high temperatures is reduced whereby the life of the dye is maintained. In addition the short tinting times required by the method of the invention also result in prolongation of the life of the dye in the dispersion.

In the case of lenses of non-tintable plastic and which have a thin, hard coating which permits tinting, for example, polycarbonate lenses or high index lenses, which have a hard coating of, for example, a vinyl ester or a polysiloxane, the tinting may take up to 12 minutes of immersion in the boiling dispersion, but this is still markedly faster than with conventional tinting techniques where tinting requires upwards of 45 minutes and frequently several hours.

Furthermore, employing the method of the invention to apply UV tints of the benzophenone class, it has been found that the tinting dispersion has a significantly longer reheat life than when the tinting dispersion is employed in the conventional methods.

In the conventional method, even though operated at lower temperatures, the benzophenone UV tints are found to degrade significantly after only 6 to 8 cycles of heating, cooling and re-heating; the degradation is such that the dispersion will no longer function and must be discarded. This degradation occurs whether the 6 to 8 cycles are over a short or a long period of time.

Employing the method of the present invention with benzophenone tints, however, the degradation does not occur even after 70 cycles of heating, cooling and reheating, even through higher heating temperatures are involved.

The reason for this result is unclear, but one theory is that the exposure to microwave radiation or the presence of the surfactant contribute to the stability.

In the present invention it is found that the dispersion can be employed until it is substantially depleted in tinting agent, and the tinting agent is not degraded.

The method of the invention achieves tinting in times that are at least 10 to 20 times shorter than in currently employed techniques, and the tinting dispersion can be employed repeatedly until it is depleted of tinting agent.

c) Tinting Dispersion

The aqueous dispersion of tinting agent suitably contains the dye or pigment and a surfactant to stabilize the dispersion.

The tinting agent is an organic dye or pigment, in particular, a high energy tinting dye or pigment or UV dye which withstands temperatures of 90° C. to 135° C. without significant degradation.

One suitable class of tinting dyes is the azo dyes available under the Trade-mark CIBACET from Ciba-Geigy Dyes Ltd. A suitable class of UV dye is the benzophenones available under the Trade-mark UVINUL of BASF.

Particular UV dyes of this class include 2,2',4,4'-tetrahydroxy benzophenone, benzophenone-6, benzoresorcinol, oxybenzone and sulisobenzone.

The azo dyes are available in red, blue and yellow and these three primary colours can be employed to make a full range of colours, employing appropriate proportions of the three primary colours.

In the preparation of the aqueous tinting dispersion weighed amounts of a tinting agent or agents are employed to provide a desired colour, and the dyes are blended with water, preferably luke warm water; suitably the dye is added slowly to the water during mixing or blending. An anti-foaming agent may be added as foaming occurs and finally a surfactant is added to stabilize the dispersion. Suitable surfactants include those derived from castor oil, for example, the ethoxylated castor oil surfactants available under the Trade-mark ALKAMULS from Rhone-Poulenc, especially Alkalmuls EP-620 which is castor oil ethoxylated (30).

Typically the dispersion is produced as a concentrate which is diluted for use.

EXAMPLES

Example 1

A red tinting dispersion was produced as follows:

Step 1)

4 liters of luke warm water were added to a high speed blender and the blender was operated at medium speed;

Step 2)

100 gms of powder red dye (CIBACET from Ciba-Geigy Dyes Ltd.) was added slowly into the water while the blender continued to operate at medium speed;

Step 3)

During the blending of the dye and water, foaming occurred; at this stage 2 ml of Antifoam 1520-US from Dow Coming was added and the foaming receded within seconds;

Step 4)

The blending was continued after completion of the addition of the dye, and 19 ml of a surfactant ALKAMULS EL-620 of Rhone-Poulenc was added, to stabilize the resulting dispersion;

Step 5)

The dispersion was blended for a further 5 minutes at high speed; thereafter 120 ml portions of the resulting dispersion concentrate were diluted with 880 ml of water to produce 1 litter of tinting dispersion.

Example 2

A surface conditioner was produced by blending 7 gms of Kiralon-ol in 1000 ml of water.

120 ml of the surface conditioner was placed in a container jar and a stainless steel grill was placed on the floor of the jar. Three CR-39 cleaned lenses were immersed in the surface conditioner, being supported by the grill at room temperature, for 10 to 30 seconds; the lenses were removed and rinsed with water.

The rinsed lenses were submerged in a portion of the tinting dispersion of Example 1 and placed on the turntable of an 800 watt microwave oven and the oven was set at high power with the timer at 2 minutes and 30 seconds, and the turntable rotating at about 6 rpm; when boiling was observed, the lenses were maintained in the boiling dispersion for 2, 30 and 60 seconds respectively. The lenses were thus removed at 2, 30 and 60 seconds respectively and rinsed with water.

The following visible light absorption levels were noted in the three lenses employing a UV and visible light transmission meter -

| Time | Absorption |
|---|---|
| 2 sec. | 10% |
| 30 sec. | 50% |
| 60 sec. | 72% |

Example 3

The existing tint on a polycarbonate lens was removed as follows:

10 gms of a surfactant RHODAFAC RS-610 of Rhone-Poulenc was mixed with 1000 ml of water; the tinted polycarbonate lens was immersed in a portion of the surfactant solution in a container with a negative (concave) face of the lens facing down and supported by a stainless steel grill on the floor of the container.

The container was placed in an 800 watt microwave oven and the power was set on high; after boiling commenced it was allowed to continue until the dye was removed from the tinted lens. The lens was removed and rinsed with water.

A UV dye was applied to the lens as follows:

Step 1)

22.5g of UVINOL D50, a 2,2 ',4,4'-tetrahydroxy benzophenone was dissolved in 1 liter of methanol to form a concentrate. An aqueous solution of surfactant was formed by blending 7 g of a surfactant KIRALON OL and 4 g of surfactant ALKAMULS EL-620 in 620 liters of water. The UVINOL concentrate was added slowly to the aqueous solution under agitation to produce the UV dye dispersion.

Step 2)

The lens was submerged in 120 ml of the UV dye dispersion in a container, the container was placed on the turntable of an 800 watt microwave oven and the oven was operated at high power, when boiling was observed the lens was maintained in the boiling UV dye dispersion for 2 minutes. The container was removed from the oven and the lens was removed from the UV dye dispersion, allowed to cool to room temperature and rinsed with water.

UV transmission readings with a UV-meter at 400 nm was less than 3%.

It was found that the UV dye dispersion could be re-used repeatedly until the UV dye content of the dispersion was exhausted.

The invention provides a simple, low cost method of tinting plastic optical lenses and other plastic articles. Tinting is completed in much shorter times than with prior tinting procedures, and the equipment employed was readily available. Since the water-based compositions do not emit organic solvent vapors at the boiling temperature employed, environmental concerns are satisfied.

I claim:

1. A method of tinting a tintable plastic optical lens, said lens being of thermoplastic or a thermoset plastic comprising:

i) immersing a tintable thermoplastic or thermoset plastic optical lens in an aqueous dispersion of a tinting agent, said dispersion and lens being supported on a rotatable platform, and said tinting agent being a high energy dye or a UV dye which withstands temperatures of 90° C. to 135° C.;

ii) exposing said aqueous dispersion with said immersed optical lens to microwave radiation to bring said dispersion to a quiescent boil, while rotating said platform, iii) maintaining said quiescent boil for a time period of at least about 2 seconds, while rotating said platform, with transfer of tinting agent from said dispersion to said optical lens to effect tinting, iv) removing the resulting tinted optical lens from said dispersion; and v) rinsing the tinted optical lens with water to remove residual dispersion.

2. A method according to claim 1, wherein said tinting agent is a high-energy dye which withstands temperatures of 90° C. to 135° C.

3. A method according to claim 1, wherein said tinting agent is a UV dye effective to produce a tint which reduces ultra violet light transmission.

4. A method according to claim 1, wherein said quiescent boil in step iii) is for a time of 2 to 120 seconds.

5. A method according to claim 4, wherein said quiescent boil in step iii) is for a time of 2 to 60 seconds.

6. A method according to claim 2, wherein said quiescent boil in step iii) is for a time of 2 to 60 seconds.

7. A method according to claim 1, including a step, prior to step i) of surface conditioning said optical lens.

8. A method according to claim 6, wherein said step of surface conditioning comprises immersing said optical lens in an aqueous solution of a surfactant effective to reduce surface tension of said optical lens such that in step iii) dye is uniformly transferred to said optical lens from said dispersion across the surface of the optical lens.

9. A method according to claim 1, wherein said aqueous dispersion contains a surfactant.

10. A method according to claim 1, wherein said optical lens is of a thermoset plastic.

11. A method according to claim 1, wherein said lens is of diethylene glycol bis(allyl)carbonate.

12. A method according to claim 1, wherein said optical lens is of a thermoplastic polycarbonate and said quiescent boil in step iii) is for a time of up to 12 minutes.

13. A method according to claim 1, including a step, prior to step i) of surface conditioning said optical lens by immersing said optical lens in an aqueous solution of a surfactant effective to reduce surface tension of said optical lens such that in step iii) dye is uniformly transferred to said optical lens from said dispersion across the surface of the optical lens; and said dispersion in step i) contains a surfactant.

14. A method according to claim 1, wherein at completion of tinting in step iii), said tinted optical lens is immediately removed from the dispersion in step iv), and rinsed in step v).

15. A method according to claim 14, wherein at completion of tinting in step iii) said microwave radiation is terminated to discontinue said quiescent boil of said dispersion.

16. A method according to claim 1, wherein said rotatable platform is a turntable in a microwave oven and said dispersion with said immersed optical lens is housed in a container supported on said turntable for rotation therewith.

17. A method according to claim 13, wherein said rotatable platform is a turntable in a microwave oven and said dispersion with said immersed optical lens is housed in a container supported on said turntable for rotation therewith.

18. A method according to claim 1, wherein said aqueous dispersion and optical lens are exposed to said microwave radiation, continuously, in steps ii) and iii).

19. A method according to claim 17, wherein said aqueous dispersion and optical lens are exposed to said microwave radiation, continuously, in steps ii) and iii).

20. A method according to claim 1, wherein said platform is rotated at 2 to 10 rpm during steps ii) and iii).

21. A method according to claim 19, wherein said platform is rotated at 4 to 8 rpm during steps ii) and iii).

22. A method according to claim 2, wherein said quiescent boil in step iii) is for a time of 2 to 120 seconds.

* * * * *